United States Patent [19]

Perez-Albuerne

[11] 3,932,179

[45] Jan. 13, 1976

[54] ELECTROPHOTOGRAPHIC ELEMENT CONTAINING A POLYMERIC MULTI-PHASE INTERLAYER

[75] Inventor: Evelio A. Perez-Albuerne, Rochester, N.Y.

[73] Assignee: Eastman Kodak Company, Rochester, N.Y.

[22] Filed: May 31, 1973

[21] Appl. No.: 365,790

[52] U.S. Cl. ..... 96/1.5; 96/87 A

[51] Int. Cl.[2] ..... G03G 5/04

[58] Field of Search ..... 96/1 R, 1.5, 1.7, 87 A, 96/115 P

[56] References Cited

UNITED STATES PATENTS

| | | | |
|---|---|---|---|
| 3,640,708 | 2/1972 | Humphriss | 96/1.5 |
| 3,656,949 | 4/1972 | Honjo et al. | 96/1.5 |
| 3,682,632 | 8/1972 | Fumiaki Arai | 96/1.5 |
| 3,745,005 | 7/1973 | Yoerger et al. | 96/1.5 |

*Primary Examiner*—David Klein
*Assistant Examiner*—John L. Goodrow
*Attorney, Agent, or Firm*—R. P. Hilst

[57] ABSTRACT

This application describes a multilayer electrophotographic element composed of a conducting layer, a photoconductive layer, and a polymeric interlayer having a surface resistivity greater than about $10^{12}$ ohm/sq. between the conducting layer and the photoconductive layer. The interlayer comprises a blend of at least two distinct polymeric phases comprising: (a) a film-forming, water- or alkali-soluble polymer, and (b) a film-forming hydrophobic polymer.

14 Claims, No Drawings

ELECTROPHOTOGRAPHIC ELEMENT CONTAINING A POLYMERIC MULTI-PHASE INTERLAYER

FIELD OF THE INVENTION

This invention relates to electrophotography, and in particular to a novel electrophotographic element comprising several functional layers. Most particularly, the invention relates to the formulation of one of these layers, the barrier layer.

RELATED ART

Many procedures can be utilized to obtain an electrostatic charge pattern and to obtain a developed image. Early work is described in Carlson U.S. Pat. No. 2,297,691, issued Oct. 6, 1942, wherein a charge pattern is formed and developed on a photoconductive element.

Electrophotographic processes and elements have been described in numerous patents and other literature, for example, in the patent of Carlson, U.S. Pat. No. 2,297,691, issued Oct. 6, 1942 and in more recent works such as "Electrophotography" by R. M. Schaffert, and "Xerography and Related Process" by Dessauer and Clark, both published by Focal Press, Ltd., 1965.

Electrophotographic processes employ electrophotographic or photoconductive elements which are commonly assembled as a multilayer element on a support. A typical arrangement of layers comprises a support having coated on it an electrically conducting layer which has substantial dark conductivity. The outer layer is a photoconductive layer which is an insulator in the dark and under illumination becomes sufficiently conductive to allow a charge leakage through the layer. Between the electrically conducting layer and the photoconductive layer a barrier layer may be inserted to prevent interaction between the photoconductive species in the outer layer and the dark-conductive species in the layer closest to the support, such interaction being quite common in many known photoconductive systems. In addition, use of a barrier layer in combination with certain known types of photoconductive layers which generally are useful when charged one way only, i.e., positively or negatively, has been found to modify the properties of such photoconductive layers so that they may provide useful electrostatic images with either negative or positive charging. Alternatively or concomitantly, the barrier layer may serve to improve the adhesion of the multilayer system. Due to these facts, the presence of the barrier layer is found to be advantageous in many electrophotographic elements.

Various references in the technical literature have been made to suitable kinds of barrier layer materials. For example, U.S. Pat. No. 2,901,348; U.S. Pat. No. 3,573,906; and U.S. Pat. No. 3,640,708 describe various polymeric materials, including certain mixtures of these materials, which have been used as barrier layer materials.

The properties of the entire multilayer element clearly depend upon the nature of each layer and its interaction with the other layers. In particular the barrier layer should have suitable electrical, adhesive, cohesive, and solvent properties to provide a useful electrophotographic element. It is known in the art that the exact formulation of this barrier layer determines, in many cases, the performance of the electrophotographic element. However, the reasons why a given barrier layer performs in a desirable way are not clearly understood at present making it virtually impossible to select a priori the composition of a useful barrier layer. Consequently, there has been a constant search for formulations of useful barrier layers to enhance the utility of multilayer electrophotographic elements.

OBJECTS OF THE INVENTION

Accordingly, it is the object of the present invention to provide an electrophotographic element containing a useful barrier layer which enhances the utility of many photoconductive and dark-conductive layers, hitherto not utilized due to lack of a suitable barrier layer.

It is likewise an object of the present invention to provide an improved multilayer electrophotographic element having a single interlayer serving as a barrier layer and as an adhesive interlayer.

Yet another object of the present invention is to provide a multilayer electrophotographic element with improved cohesive properties.

Still another object of the present invention is to provide an electrophotographic element which contains an organic photoconductive layer coated on a barrier layer which is resistant to solvent attack by conventional organic solvents, for example, chlorinated hydrocarbons, used to coat organic photoconductive compositions.

SUMMARY OF THE INVENTION

In accord with the present invention there is provided a unitary electrophotographic element comprising a conductive layer, a photoconductive layer, and a polymeric interlayer having a surface resistivity of greater than about $10^{12}$ ohm/sq. between the conductive layer and the photoconductive layer, said interlayer comprising a blend of at least two distinct polymeric phases comprising; (a) an electrically insulating, film-forming, hydrophobic polymer as a first polymeric phase, and (b) a film-forming, water- or alkali-soluble polymer as a second polymeric phase. In accord with the invention a single polymeric interlayer of the type described above may serve both as a barrier layer and as an adhesive layer for the electrophotographic element.

DESCRIPTION OF THE PREFERRED EMBODIMENTS

The multi-phase polymeric interlayer used in the elements of the present invention have numerous advantages. Among other advantages, the polymeric interlayer, because of its multi-phase properties, possesses useful barrier layer properties; that is, the layer substantially reduces charge leakage from the photoconductive layer to the conductive layer in the absence of activity radiation (i.e. "dark decay") but does not prevent proper charge dissipation of the photoconductive layer in the presence of activating radiation.

In addition, because of its multi-phase properties, the polymeric interlayer used in the present invention readily adheres to a photoconductive layer coated thereon, particularly to an organic photoconductive layer coated thereon from conventional organic solvents, for example, chlorinated hydrocarbons. Nevertheless, the multi-phase polymeric layer used in the elements of the present invention is resistant to destruction by these same organic solvents.

A further advantage of the polymeric multi-phase interlayer used in the present invention is that this layer, again because of its multi-phase characteristic, may enhance solid area development on the surface of the overlying photoconductive layer.

The hydrophobic polymer phase of the multiphase interlayer used in the present invention, due to the electrical insulating properties and hydrophobicity of this phase, contributes substantially to the overall resistivity of the multi-phase interlayer and to its adhesive properties, especially its adhesion to organic solvent coated photoconductive layers applied to the surface of the polymeric interlayer.

On the other hand, the water- or alkali-soluble polymeric phase, because of its general incompatibility with most organic solvents, particularly chlorinated hydrocarbon solvents, prevents the destruction of the multiphase interlayer by conventional organic solvents used to apply an overlying photoconductive layer. In addition, the water- or alkali-soluble polymeric phase, because of its intermediate electrical resistivity, provides the resultant multi-phase interlayers with areas of differential resistivity, corresponding to the different polymeric phases present in the interlayer. These areas of differential resistivity characteristic of the multiphase interlayers used in the present invention may be identified by observing differences in image density of electron micrographs taken of these multi-phase interlayers. It is these areas of differential resistivity within the multi-phase interlayers which are believed to be responsible for (a) permitting sufficient charge dissipation of the overlying photoconductive layer in the presence of activating radiation and (b) enhancing solid area development of the overlying photoconductive layer.

The multi-phase characteristic of the polymeric interlayer used in the present invention is discernible, as noted above, by observing differences in image density appearing in electron micrographs of these interlayers. In addition, the multi-phase character of the polymeric interlayer is responsible for the generally hazed appearance this layer possesses when coated and dried on the surface of the underlying conductive layer used in the multilayer electrographic elements of the present invention. This hazed appearance contrasts to the optically clear layers which are characteristic of prior art polymeric barrier layers such as those described in Humphriss et.al. U.S. Pat. No. 3,640,708 which are composed of a blend of cellulose nitrate and a tetrapolymer of methyl acrylate, acrylonitrile, acrylic acid and vinylidene chloride. See Column 3, lines 65-70 of U.S. Pat. No. 3,640,708. The optical clarity of the polymeric barrier layer described in U.S. Pat. No. 3,640,708 is due to the single polymer phase, i.e., the homogeneity of the polymer blend, used in these prior art barrier layers.

It may be observed that the hazed appearance of the multi-phase interlayers does not substantially detract from the resultant multilayer electrographic elements of the present invention which contain these multiphase interlayers. This is because it has been found that the hazed appearance of the interlayer is substantially reduced upon overcoating the dried interlayer with an organic solvent-containing photoconductive composition. As a result, the overcoated interlayer appears essentially clear. Although the hazed appearance of the interlayer can be visually reduced as explained above, the hydrophobic and water- or alkali-soluble polymer components of the interlayer remain in a multi-phase or heterogeneous form. That is, the above-described reduction in haze of the layer does not convert the layer to a homogeneous polymer blend.

The multi-phase polymeric property of the interlayers used in the present invention is due to the incompatibility existing between the hydrophobic and the water- or alkali-soluble polymer materials of the layer. Because of the incompatibility of these materials, the resultant interlayer possesses the heterogeneous, multiple polymeric phase structure described above.

The surface resistivity of the dry, multi-phase polymeric interlayer of the present invention is greater than about $10^{12}$ ohms/sq. as measured at room temperature (25°C) and one atmosphere pressure under 40% relative humidity conditions. This degree of electrical resistivity is needed to prevent the layer from becoming too conductive and functioning simply as an electrically conducting layer, rather than as a barrier layer.

To attain a multi-phase polymeric interlayer having an electrical resistivity of greater than about $10^{12}$ ohms/sq., it is desirable to employ as the hydrophobic film-forming polymeric component of the layer an electrically insulating hydrophobic film-forming polymer or mixture of such polymers. As the water- or alkali-soluble film-forming polymeric component of the multiphase interlayer, it is desirable to employ one or more film-forming, water- or alkali soluble polymers which has an effective electrical resistivity which at 40% relative humidity is less than that of the hydrophobic polymer, preferably at least one order of magnitude less than that of the hydrophobic polymer. The lower resistivity of the water- or alkali-soluble polymeric component ensures that the resultant multi-phase interlayer does not become so highly resistive that it prevents the overlying photoconductive insulating layer from discharging when exposed to activating radiation.

A variety of film-forming, water- or alkali-soluble polymers may be used in the multi-phase interlayer of the electrophotographic element of the present invention. The term "water- or alkali-soluble polymer(s)" as used herein is defined to mean polymer(s) soluble in aqueous media having a pH of 7.0 to less than 12. Representative useful film-forming, water- or alkali-soluble polymeric materials are (1) gelatin, (2) poly(vinyl alcohol), and (3) polymers, including homopolymers and copolymers, comprising a backbone chain of repeating hydrocarbon units and acidic groups containing up to ten carbon atoms as pendant side chains chemically bonded to the backbone chain. Useful acidic groups may be selected from the group consisting of sulfonic acids, carboxylic acids, and carboxylic acid anhydrides. Pendant sidechains composed of other groups, for example, such as hydroxy, alkoxy, and ester groups having up to ten carbon atoms may also be present in the aforementioned type (3) polymers. Typically, the type (3) polymers have at least 3 or more repeating units in the backbone chain. Exemplary of suitable type (3) polymers are polymers of $\alpha,\beta$-ethylenically unsaturated carboxylic acids such as poly(acrylic acid) and poly(methacrylic acid), copolymers of $\alpha,\beta$-ethylenically unsaturated carboxylic acids and other polymerizable $\alpha,\beta$- ethylenically unsaturated monomers such as a copolymer of an alkyl acrylate and/or alkyl methacrylate polymerized with methacrylic acid and/or acrylic acid or a copolymer of a vinylene ether and a maleic monomer; polymers and copolymers of $\alpha,\beta$- ethylenically unsaturated sulfonated monomers such as a polymer of a sulfonated styrene or a polymer of a sulfoalkyl acrylate or a polymer of a sulfoalkyl methacrylate.

Especially useful water- or alkali-soluble polymers for use in the multi-phase polymeric interlayer are copolymers of one or more maleic monomers and one or more vinylene ethers. Useful maleic monomers include maleic anhydride, maleic acid and the half esters of maleic acid. Representative of such maleic monomers are compounds having the following formula:

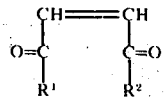

I.

wherein $R^1$ and $R^2$, when taken separately, represent a hydroxy group or an alkoxy group containing one to about six carbon atoms, with the proviso that at least one of these groups, i.e., either $R^1$ or $R^2$, is a hydroxy group; and, when taken together, $R^1$ and $R^2$ represent an oxa group (i.e., —O—). Particularly good results have been obtained in accord with the invention using maleic anhydride as the maleic monomer.

Particularly useful vinylene ethers are alkyl vinyl ethers wherein the alkyl is acyclic, i.e., $CH_2{=}CH{-}O{-}R$ wherein R is alkyl, straight- or branched-chain, having from 1 to 6 carbon atoms or substituted alkyl, wherein the substituents are those having no deleterious effect on the polymerization, e.g., halogen, hydroxy, etc. Copolymers of vinylene ethers and maleic monomers suitable for use in the present invention are copolymers of vinyl alkyl ethers and maleic monomers which contain repeating units which may be represented as follows:

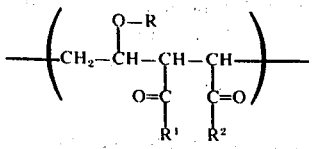

II.

wherein R, $R^1$, and $R^2$ are as defined above. These copolymers are water-soluble and 1 g. of these copolymers admixed in 100 ml. of 2-butanone typically have a specific viscosity $\mu_{sp}$ of about 0.1 to about 3.5 as measured at 25°C.

Also suitable are copolymers of a maleic monomer and cyclic vinylene ethers wherein the cyclic vinylene ether has 2 to about 8 carbon atoms and may be represented as

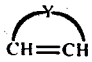

III.

wherein Y represents the carbon and oxygen atoms necessary to complete a saturated, cyclic ether group, including poly ethers. Exemplary of such cyclic vinylene ethers is p-dioxene. Copolymers of p-dioxene and maleic anhydride are characterized by the following repeating unit in their polymeric structure:

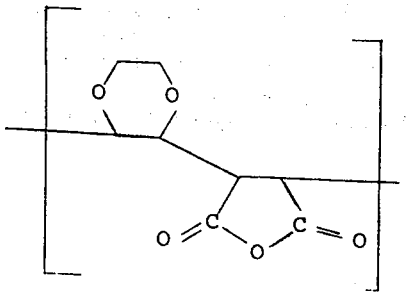

Especially useful copolymers in the present invention are poly(vinyl methyl ether-maleic anhydride), poly(vinyl chloromethyl ether-maleic anhydride), poly(vinyl isopropyl ether-maleic anhydride), poly(vinyl butyl ether-maleic anhydride), poly(vinyl isobutyl ether-maleic anhydride) mixtures thereof, and the like.

A variety of electrically insulating, film-forming, hydrophobic polymers may be used in the multi-phase interlayer of the electrophotographic element of the invention. Representative hydrophobic polymers which may be used include polyesters; polycarbonates; and hydrophobic polymers of polymerizable $\alpha,\beta$-ethylenically unsaturated monomers. Such polymers include, for example, poly(vinyl formal), poly(vinyl butyral), poly(vinyl chloride), poly(styrene-acrylonitrile), acrylic polymers such as poly(methyl acrylate) and poly(methyl methacrylate), and the like.

Hydrophobic polymers especially useful in the present invention are copolymers, including terpolymers and tetrapolymers, of vinylidene chloride and at least one other different polymerizable $\alpha,\beta$-ethylenically unsaturated monomer containing 3 to about 12 carbon atoms. The latter monomer may be selected from a variety of well-known polymerizable $\alpha,\beta$-ethylenically unsaturated materials including those having the formula:

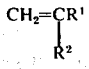

V.

wherein $R^1$ is hydrogen or methyl and $R^2$ is selected from the group consisting of organo radicals having 1 to about 10 carbon atoms including alkyl radicals, cyano radical, amide radicals, carboxylic acid radicals, ester radicals, aryl radicals, such as phenyl including alkyl substituted phenyls, and the like. These hydrophobic copolymers typically contain at least about 40 percent by weight vinylidene chloride. Preferably the hydrophobic copolymer is prepared from about 60 to about 90 percent by weight vinylidene chloride and from about 40 to about 10 percent by weight of the other monomer(s). In those situations where the other $\alpha,\beta$-ethylenically unsaturated monomers copolymerized with vinylidene chloride contain a hydrophilic group such as an amide, a cyano group, or a carboxylic acid group as the organo radical identified as $R^2$ in Formula V above, it is desirable to use a total of less than about 25 percent by weight of such monomers in the resultant copolymer. This is simply to insure that the resultant copolymer is hydrophobic. Representative of such materials are the following polymers: poly(vinylidene chloride-methyl acrylate-itaconic acid), poly(vinylidene chloride-acrylonitrole-acrylic acid), poly(vinylidene chloride-acrylonitrile-methyl acrylate), poly-(vinylidene chloride-acrylonitrile), poly(vinylidene chloride-methacrylonitrile), and poly(-vinylidene chloride-methyl acrylate).

The proportions of water- or alkali-soluble polymer to hydrophobic polymer may vary widely. Suitable admixtures comprise about 10% to 60% by weight water- or alkali-soluble polymer(s) and about 40% to 90% by weight hydrophobic polymer(s). Preferred, however, is an admixture having from about 20 to 50% by weight water- or alkalisoluble polymer(s) and about 50 to 80% by weight hydrophobic polymer(s). It will be appreciated that suitable interlayers may contain mixtures of two or more different hydrophobic polymers as the hydrophobic polymer component and mixtures of two or more water- or alkali-soluble polymers.

The polymer blend forming the barrier layer is usually applied by coating a solution of the polymers and evaporating the solvent or mixture of solvents. Upon evaporation of the solvent, the dry, hazy-appearing multiphase polymeric interlayer used in the present invention is obtained. Choice of solvents depends upon the nature of the conductive layer above which the barrier layer is applied, and also on the properties of the polymers constituting the barrier layer. Appropriate solvents can in general be selected based on the known properties of the individual polymers, as is well known in the art. It is generally found that mixtures of solvents are most effective, due to the dissimilar nature of the polymers used in the blend. These solvents are usually selected from conventional organic solvents such as alcohols, ketones, esters, ethers, chlorinated solvents, and hydrocarbons.

The unitary electrophotographic elements of the present invention can include a variety of electrically conducting supports, such as various papers or conventional film supports, e.g., cellulose acetate, cellulose nitrate, polystyrene, poly(ethylene terephthalate), poly(vinyl acetal), polycarbonate and related films having a conductive substrate thereon. An especially useful conducting support can be prepared as described in Gramza et al U.S. Pat. No. 3,597,272 by coating a transparent film support material with a layer having a semiconductor such as cuprous iodide imbibed therein. Suitable conducting layers also can be prepared from the sodium salt of a carboxyester lactone of maleic anhydride-vinyl acetate copolymer or from an organic semiconductor dispersed in a resinous binder. Typical conducting layers and methods for their optimum preparation and use are disclosed in Minsk U.S. Pat. No. 3,007,901, issued Nov. 7, 1961; Trevoy U.S. Pat. No. 3,245,833, issued Apr. 12, 1966; Sterman et al U.S. Pat. No. 3,262,807, issued July 26, 1966; etc.

Additional useful conductive layers include carbon-containing layers such as conductive carbon particles dispersed in a resin binder. Metal coated papers; metal-paper laminates; metal foils such as aluminum foil, etc; metal plates such as aluminum, copper, zinc, brass and galvanized plates, etc; as well as vapor deposited metal layers such as silver, nickel, or aluminum on conventional film supports are also useful as are conductive or conductor-coated glasses.

Photoconductive layers in the electrographic element typically comprise a photoconductor and optionally a binder and/or a sensitizer. Typically, this layer has a thickness in the range of about 1 micron to about 500 microns after drying. Useful results can be obtained where the photoconductor is present in an amount ranging from about 1 weight percent to about 99 weight percent of the coating composition. A wide variety of photoconductors can be used in electrophotographic elements. Useful photoconductors can be inorganic as well as organic, including organo-metallic photoconductive compounds. Examples of various photoconductors include the following:

A. Inorganic photoconductors such as zinc oxide, zinc sulfide, cadmium selenide, zinc silicate, cadmium sulfide, arsenic triselenide, antimony trisulfide, lead oxide, titanium dioxide, others as listed, for example, in Middleton et al. U.S. Pat. No. 3,121,006, issued Feb. 11, 1964; and selenium;

B. Arylamine photoconductors including substituted and unsubstituted arylamines, diarylamines, non-polymeric triarylamines and polymeric triarylamines such as those described in Fox U.S. Pat. No. 3,240,597, issued Mar. 15, 1966 and Klupfel et al. U.S. Pat. No. 3,180,730, issued Apr. 27, 1965;

C. Polyarylalkane photoconductors of the types described in Noe et al U.S. Pat. No. 3,274,000, issued Sept. 20, 1966, Wilson U.S. Pat. No. 3,542,547, issued Nov. 24, 1970 and in Seus et al. U.S. Pat. No. 3,542,544, issued Nov. 24, 1970;

D. 4-Diarylamino-substituted chalcones of the types described in Fox U.S. Pat. No. 3,526,501, issued Sept. 1, 1970;

E. Non-ionic cycloheptenyl compounds of the types described in Looker U.S. Pat. No. 3,533,786, issued Oct. 13, 1970;

F. Compounds containing an N-N nucleus, as described in Fox U.S. Pat. No. 3,542,546, issued Nov. 24, 1970;

G. Organic compounds having a 3,3′-bis-aryl-2-pyrazoline nucleus, as described in Fox et al U.S. Pat. No. 3,527,602, issued Sept. 8, 1970;

H. Triarylamines in which at least one of the aryl radicals is substituted by either a vinyl radical or a vinylene radical having at least one active hydrogen-containing group, as described in Brantly et al U.S. Pat. No. 3,567,450, issued Mar. 2, 1971;

I. Triarylamines in which at least one of the aryl radicals is substituted by an active hydrogen-containing group, as described in Brantly et al. Belgian Pat. No. 728,563, dated Apr. 30, 1969;

J. Organo-metallic compounds having at least one aminoaryl substituent attached to a Group IVa or Group Va metal atom, as described in Goldman et al. Canadian Pat. No. 818,539, dated July 22, 1969;

K. Organo-metallic compounds having at least one aminoaryl substituent attached to a Group IIIa metal atom, as described in Johnson Belgian Pat. No. 735,334, dated Aug. 29, 1969;

L. Charge transfer combinations, e.g., those comprising a photoconductor and a Lewis acid, as well as photoconductive compositions involving complexes of non-photoconductive material and a Lewis acid, such as described, for example, in Jones U.S. Defensive Publication T881,002, dated Dec. 1, 1970 and Mammino U.S. Pat. Nos. 3,408,181 through 3,408,190, all dated Oct. 29, 1968 and Inami et al. U.S. Pat. No. 3,418,116, dated Dec. 24, 1968.

The binder materials useful in forming photoconductive compositions include a wide variety of film-forming resinous materials. Typical binders for use in preparing the photoconductive layers are film-forming, hydrophobic polymeric materials having a fairly high dielectric strength and which are good electrically insulating film-forming vehicles. Materials of this type include styrene-butadiene copolymers; silicone resins; styrene-alkyd resins; silicone-alkyd resins; soya-alkyd resins; poly(vinyl chloride); poly (vinylidene chloride); vinylidene chloride-acrylonitrile copolymers; poly(vinyl acetate); vinyl acetate-vinyl chloride copolymers; poly(vinyl acetals), such as poly(vinyl butyral); polyacrylic and methacrylic esters, such as poly(methyl methacrylate), poly(n-butyl methacrylate), poly(isobutyl methacrylate), etc; polystyrene; nitrated polystyrene; polymethylstyrene; isobutylene polymers; polyesters, such as poly[ethylene-co-alkylenebis(alkylenoxyarylene) phenylenedicarboxylate]; phenolformaldehyde resins; ketone resins; polyamides; polycarbonates; polythiocarbonates; poly[ethylene-co-isopropylidene-2,2-bis-(ethylenoxyphenylene) terephthalate]; copolymers of vinyl haloarylates and vinyl acetate such as poly(vinyl-m-bromobenzoate-co-vinyl acetate); etc. Methods of making resins of this type have been described in the prior art, for example, styrene-alkyd resins can be prepared according to the method described in Gerhart U.S. Pat. No. 2,361,019, issued Oct. 24, 1944 and Rust U.S. Pat. No. 2,258,423, issued Oct. 7, 1941. Suitable resins of the type contemplated for use in the photoconductive layers of the invention are sold under such tradenames as VITEL PE-101, CYMAC, Piccopale 100, Saran F-220, and LEXAN 145. Other types of binders which can be used in photoconductive layers include such materials as paraffin, mineral waxes, etc.

Sensitizing compounds useful in electrophotographic elements can be selected from a wide variety of materials, including such materials as pyrylium dye salts including thiapyrylium dye salts and selenapyrylium dye salts disclosed in VanAllan et al U.S. Pat. No. 3,250,615, issued May 10, 1966; fluorenes, such as 7,12-dioxo-13-dibenzo(a,h)fluorene, 5,10-dioxo-4A,11-diazabenzo(b)fluorene, 3,13-dioxo-7-oxadibenzo(b,g)fluorene, and the like; aggregate-type sensitizers of the type described in Light Belgian Pat. 705,117, dated Apr. 16, 1968; aromatic nitro compounds of the kind described in Minsk et al. U.S. Pat. No. 2,610,120, issued Sept. 9, 1952; anthrones like those disclosed in Zvanut U.S. Pat. No. 2,670,284, issued Feb. 23, 1954; quinones, Minsk et al U.S. Pat. No. 2,670,286, issued Feb. 23, 1954; benzophenones, Minsk et al U.S. Pat. No. 2,670,287, issued Feb. 23, 1954; thiazoles, Robertson et al U.S. Pat. No. 2,732,301, issued Jan. 24, 1956; mineral acids; carboxylic acids, such as maleic acid, di- and trichloroacetic acids, and salicyclic acids; sulfonic and phosphoric acids; and other electron acceptor compounds as disclosed by H. Hoegl, J. Phys. Chem., 69, No. 3, 755–766 (March, 1965), and Hoegl et al. U.S. Pat. No. 3,232,755, issued Feb. 1, 1966.

Electrophotographic elements can be overcoated with an outer protective layer if desired. This overcoat layer can function as a protective overcoat to prevent damage from abrasion or from chemical attack of solvents such as those used in liquid developing procedures, etc. Suitable overcoats can be selected from a wide variety of materials which are typically insulating such as waxes, insulating resins, e.g., polystyrene, urea-, phenol- and melamine-formaldehyde resins, vinyl resins, cellulose esters, silicone resins, poly(vinyl acetals), etc. Various overcoats are described, for example, in Dessauer U.S. Pat. No. 2,901,348, issued Aug. 25, 1959; Kinsella U.S. Pat. No. 3,146,145 issued Aug. 25, 1964; and Deubner U.S. Pat. No. 2,860,048, issued Nov. 11, 1958. In addition, certain inorganic materials can be used as described, for example, in Corrsin U.S. Pat. No. 3,288,604, issued Nov. 29, 1966 and Kaiser U.S. Pat. No. 3,092,493, issued June 4, 1963.

EXAMPLE 1

A solution containing 1.75 g of poly(vinyl methyl ethermaleic anhydride) and 3.25 g of poly(methyl acrylate-vinylidene chloride-itaconic acid) in a mixture of 30 ml of methyl acetate and 170 ml of methyl isobutyl ketone is prepared. This solution is coated onto an electrically conducting layer composed of an organic semiconductor dispersed in a poly(methyl methacrylatemethacrylic acid) binder. The conducting layer is carried on a flexible insulating substrate. After evaporating the solvent, a hazy-appearing multi-polymeric phase barrier layer about 0.4 μm thick is formed on the conducting layer. Differences in the optical density of electron micrographs taken of this barrier layer indicate areas of differential resistivity within the layer. An electrophotographic element is made by coating a photoconductive layer on the barrier layer. This photoconductive layer is solvent-applied from chlorinated organic solvents, and contains an organic photoconductor dispersed in an "aggregate" composition of a thiapyrylium dye salt and a polycarbonate polymer as described in Light, U.S. Pat. No. 3,615,414. Upon application of the photoconductive layer, the barrier layer appears substantially clear.

Tests of the resultant unitary multilayer element indicate no chemical interaction between photoconductor and conducting layers. An adhesive tape test of the element indicates good adhesion and cohesion of all layers. The sensitometry of the electrophotographic element is found to be essentially equivalent to that of a control in which the same photoconductive layer is applied directly on a conducting nickel substrate which does not interact with the photoconductive layer and therefore does not require a barrier layer. The electrophotographic element is also found to perform well in a 100-cycle regeneration test and to operate in both a positive- and negative-charge mode.

The use of only the poly(vinyl methyl ethermaleic anhydride) as the barrier layer produces a system with no useful adhesion, while the barrier layer having only the poly(methyl acrylate-vinylidene chloride-itaconic acid) is seriously damaged by the chlorinated solvents used in applying the photoconductive layer. In contrast the polymer blend produces the required combination of satisfactory adhesion, suitable electrical behavior and outstanding resistance to attack by the solvent system of the photoconductor layer.

EXAMPLE 2

A solution identical to that of Example 1 is coated on a flexible insulating support over a conductive layer containing imbibed cuprous iodide. Evaporation of the solvent gives a barrier layer about 0.4 μm thick. A photoconductive layer similar to that of Example 1 is coated onto the barrier layer. Tests of the coated system indicated no deterioration of electrical resistivity of the cuprous iodide layer and excellent adhesion. Electrophotographic tests show that the system operates satisfactorily in both a positive- and negative-charge mode.

The invention has been described in detail with particular reference to preferred embodiments thereof, but, it will be understood that variations and modifications can be effected within the spirit and scope of the invention.

I claim:

1. In a unitary electrophotographic element comprising a conductive layer, a photoconductive layer, and a polymeric interlayer having a surface resistivity greater than about $10^{12}$ ohm/sq. between the conductive layer and the photoconductive layer, the improvement wherein said interlayer is a blend of at least two distinct solid polymeric phases comprising (a) an electrically insulating, film-forming, hydrophobic polymer as a first polymeric phase and (b) a film-forming, water- or alkali-soluble polymer having an electrical resistivity less than that of the hydrophobic polymer as a second polymeric phase.

2. An electrophotographic element according to claim 1 wherein said hydrophobic polymer is selected from the group consisting of polyesters, polycarbonates, and hydrophobic polymers of polymerizable $\alpha,\beta$-ethylenically unsaturated monomers.

3. An electrophotographic element according to claim 1 wherein said water- or alkali-soluble polymer is selected from the group consisting of gelatin, poly(vinyl alcohol), and polymers comprising a backbone chain of repeating hydrocarbon units and acidic groups containing up to ten carbon atoms as pendant side chains chemically bonded to the backbone chain, said acidic groups selected from the group consisting of sulfonic acids, carboxylic acids, and carboxylic acid anhydrides.

4. In a unitary electrophotographic element comprising a conductive layer, a photoconductive layer, and a polymeric interlayer having a surface resistivity greater than about $10_{12}$ ohm/sq. between the conductive layer and the photoconductive layer, the improvement wherein said interlayer is a blend of at least two distinct solid polymeric phases comprising (a) an electrically insulating, film-forming, hydrophobic polymer as a first polymeric phase, and (b) a film-forming, water- or alkali-soluble polymer of a vinylene ether and a maleic monomer having an electrical resistivity less than that of the hydrophobic polymer as a second polymeric phase, said maleic monomer having the following formula:

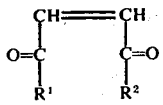

wherein $R^1$ and $R^2$, when taken separately, represent a hydroxy group or an alkoxy group having 1 to about 6 carbon atoms with the proviso that at least one of $R^1$ or $R^2$ represents a hydroxy group; and, when taken together, $R^1$ and $R^2$ represent an oxa group.

5. An electrophotographic element according to claim 4 wherein the electrically insulating, film-forming, hydrophobic polymer comprises from about 40 to 90% by weight of the polymer interlayer.

6. In an electrophotographic element according to claim 4 wherein the vinylene ether is an alkyl vinyl ether having the formula $CH_2{=}CH\text{-}O\text{-}R$ wherein R is alkyl.

7. An electrophotographic element according to claim 4 wherein the vinylene ether is a cyclic vinylene ether.

8. An electrophotographic element according to claim 4 wherein the electrically insulating, film-forming, hydrophobic polymer is a polymer of at least one polymerizable $\alpha,\beta$-ethylenically unsaturated monomer.

9. In a unitary electrophotographic element comprising a conductive layer, an organic photoconductive layer and a single polymeric interlayer having a surface resistivity greater than about $10^{12}$ ohms/sq. between the conductive layer and the organic photoconductive layer, the improvement wherein said interlayer is a blend of two distinct solid polymeric phases comprising about 40 to about 90% by weight of an electrically insulating, film-forming, hydrophobic copolymer of vinylidene chloride as a first polymeric phase and about 60 to about 10% by weight of a film-forming, water soluble copolymer of a vinylene ether and maleic anhydride having an electrical resistivity less than that of the hydrophobic copolymer as a second polymeric phase.

10. An electrophotographic element according to claim 9 wherein said copolymer of vinylidene chloride is a copolymer of at least about 40 percent by weight vinylidene chloride and at least one other polymerizable monomer having the formula:

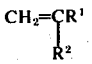

wherein $R^1$ is hydrogen or methyl and $R^2$ is an organic radical having 1 to about 10 carbon atoms.

11. An electrophotographic element according to claim 9 wherein said copolymer of a vinylene ether and maleic anhydride is selected from the group consisting of poly(vinyl methyl ether-maleic anhydride),
poly(vinyl chloroethyl ether-maleic anhydride),
poly(vinyl isopropyl ether-maleic anhydride),
poly(vinyl butyl ether-maleic anhydride),
poly(vinyl isobutyl ether-maleic anhydride).

12. An electrophotographic element according to claim 9 wherein the vinylene ether is p-dioxene.

13. An electrophotographic element according to claim 9 wherein said copolymer of vinylidene chloride is selected from the group consisting of poly(vinylidene chloride-methyl acrylate-itaconic acid),
poly(vinylidene chloride-acrylonitrile-acrylic acid),
poly(vinylidene chloride-acrylonitrile-methyl acrylate),
poly(vinylidene chloride-acrylonitrile),
poly(vinylidene chloride-methacrylonitrile), and
poly(vinylidene chloride-methyl acrylate).

14. An electrophotographic element according to claim 9 wherein said copolymer of vinylidene chloride is poly(vinylidene chloride-methyl acrylate-itaconic acid).

* * * * *